US007757758B2

(12) United States Patent
O'Malley et al.

(10) Patent No.: US 7,757,758 B2
(45) Date of Patent: Jul. 20, 2010

(54) EXPANDABLE WELLBORE LINER

(75) Inventors: Edward J. O'Malley, Houston, TX (US); Robert S. O'Brien, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 284 days.

(21) Appl. No.: 11/605,073

(22) Filed: Nov. 28, 2006

(65) Prior Publication Data

US 2008/0121390 A1 May 29, 2008

(51) Int. Cl.
*E21B 23/00* (2006.01)
*E21B 43/10* (2006.01)

(52) U.S. Cl. ..... 166/207; 166/242.1; 166/206

(58) Field of Classification Search ..... 166/242.1, 166/207, 206, 241.6, 241.7; 175/323, 325.5
See application file for complete search history.

(56) References Cited

U.S. PATENT DOCUMENTS

| | | | | |
|---|---|---|---|---|
| 4,043,410 | A * | 8/1977 | Bennett et al. | 175/323 |
| 4,658,896 | A * | 4/1987 | Milam | 166/241.6 |
| 4,949,788 | A * | 8/1990 | Szarka et al. | 166/285 |
| 6,263,968 | B1 * | 7/2001 | Freeman et al. | 166/313 |
| 6,571,871 | B2 * | 6/2003 | Lauritzen et al. | 166/227 |
| 6,725,939 | B2 | 4/2004 | Richard | |
| 6,932,161 | B2 | 8/2005 | Cameron | |
| 2003/0056948 | A1 | 3/2003 | Cameron | |
| 2003/0164236 | A1 | 9/2003 | Thornton | |
| 2005/0077052 | A1 | 4/2005 | Ohmer | |
| 2005/0139359 | A1 | 6/2005 | Maurer et al. | |
| 2005/0150654 | A1 | 7/2005 | Kirk et al. | |
| 2005/0155772 | A1 | 7/2005 | Dusterhoft et al. | |
| 2005/0173130 | A1 | 8/2005 | Richard | |
| 2006/0124310 | A1 * | 6/2006 | Lopez de Cardenas et al. | 166/313 |

OTHER PUBLICATIONS

Garfield, G., SPE 96660, New One-Trip Sand-Control Completion System That Eliminates Formation Damage Resulting from Conventional Perforating and Gravel-Packing Operations, Society of Petroleum Engineers, Oct. 9-12, 2005, 1-5.
Garfield, G., IPTC 10955, Eliminating Perforating-Related Formation Damage in Gravel-Pack Applications Utilizing New One-Trip-Sand Control Completion Technology, International Petroleum Technology Conference, Nov. 21-23, 2005, 1-5.
Chung Lau, Hon, Openhole Expandable-Sand-Screen Completions in Brunei, Society of Petroleum Engineers, SPE Drilling & Completion, Mar. 2004, 46-51.

(Continued)

*Primary Examiner*—David J Bagnell
*Assistant Examiner*—Cathleen R Hutchins
(74) *Attorney, Agent, or Firm*—Steve Rosenblatt

(57) ABSTRACT

A wellbore tubular has openings in its wall. An outer sleeve has ridges on which openings are located so that they communicate with the tubular openings. The tubular can be expanded to plant the ridges against the formation while any space between the ridges and the borehole wall can be used for pumping cement without fouling the aligned openings between the tubular and the sleeve. Optionally the sleeve can swell with or without tubular expansion. The openings can be initially sealed for delivery to the desired location and then opened using well or added fluids or well conditions.

21 Claims, 1 Drawing Sheet

OTHER PUBLICATIONS

Stewart, R.B., An Expandable=Slotted-Tubing, Fiber-Cement Wellbore-Lining System, Society of Petroleum Engineers, SPE Drilling & Completion, Sep. 1997, 163-167.

Garfield, G., "New One-Trip Sand-Control Completion System that Eleminates Formation Damage Resulting From Conventional Perforating and Gravel-Packing Operations", SPE 96660, Oct. 2005, 1-5.

McElfresh, P., "Maximizing Inflow Performance in Soft Sand Completions Using New One-Trip Sand Control completion Technology", SPE 94622, May 2005, 1-5.

Garfield, G., "New One-Trip Completion Technology for Sand Control Applications", SPE 94239, Jun. 2005, 1-6.

* cited by examiner

EXPANDABLE WELLBORE LINER

FIELD OF THE INVENTION

The field of the invention relates to well completions that do not need perforating.

BACKGROUND OF THE INVENTION

Completion involves creating passages from the formation though a liner or casing. The passages can be created by perforating guns but their use adversely affects the formation and can damage it to the point of reducing production.

Alternative ways to obtain access to the formation have been devised. One involves telescoping pistons that extend with pressure into the formation and take flow from the formation through a passage in the center of the piston that is available after the piston is extended. Such designs are discussed Society of Petroleum Engineers (SPE) Papers 94239, 94622 and 96660. While this technique is effective it has moving parts and many seals and extension of all the pistons is somewhat dependent on them all responding to applied pressure and extending at once before their central passage is blown clear by applied pressure.

Liners or casing have in the past been expanded after placement in a wellbore, as have screens. One example is U.S. Pat. No. 6,932,161. These tubulars that are intended to be expanded have been run in with centralizers that are compliant so as not to significantly increase the expansion force required. These centralizers have featured a series of ridges that are longitudinal, spiral or other patterns as shown in U.S. Pat. No. 6,725,939 and Application US 2003/0164236. Other applications of tubulars that are expanded can be seen in US 2005/0173130.

What is needed is a simpler design to allow tubular expansion to take place while providing access for production to come though while still leaving open the option to cement the expanded tubular. The present invention addresses this need by provision of openings on a tubular and surrounding the tubular with an outer sleeve that has ridges with openings on the ridges. Expansion of the tubular and/or the sleeve is contemplated. The sleeve openings align with the openings in the tubular and are forcibly positioned against the borehole wall to allow production through the aligned openings and cementing to go on among the ridges without fouling the openings. These and other features of the present invention will become more apparent to those skilled in the art from a review of the description of the preferred embodiment and the associated drawing while recognizing that the full scope of the invention can be found in the claims.

SUMMARY OF THE INVENTION

A wellbore tubular has openings in its wall. An outer sleeve has ridges on which openings are located so that they communicate with the tubular openings. The tubular can be expanded to plant the ridges against the formation while any space between the ridges and the borehole wall can be used for pumping cement without fouling the aligned openings between the tubular and the sleeve. Optionally the sleeve can swell with or without tubular expansion. The openings can be initially sealed for delivery to the desired location and then opened using well or added fluids or well conditions.

DETAILED DESCRIPTION OF THE PREFERRED EMBODIMENT

Figure 2:
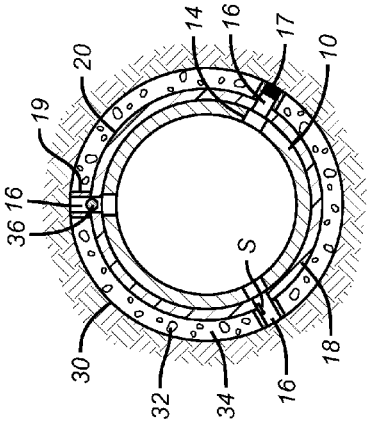
FIG. 2 is a section view along line 2-2 of FIG. 1.
Figure 1:
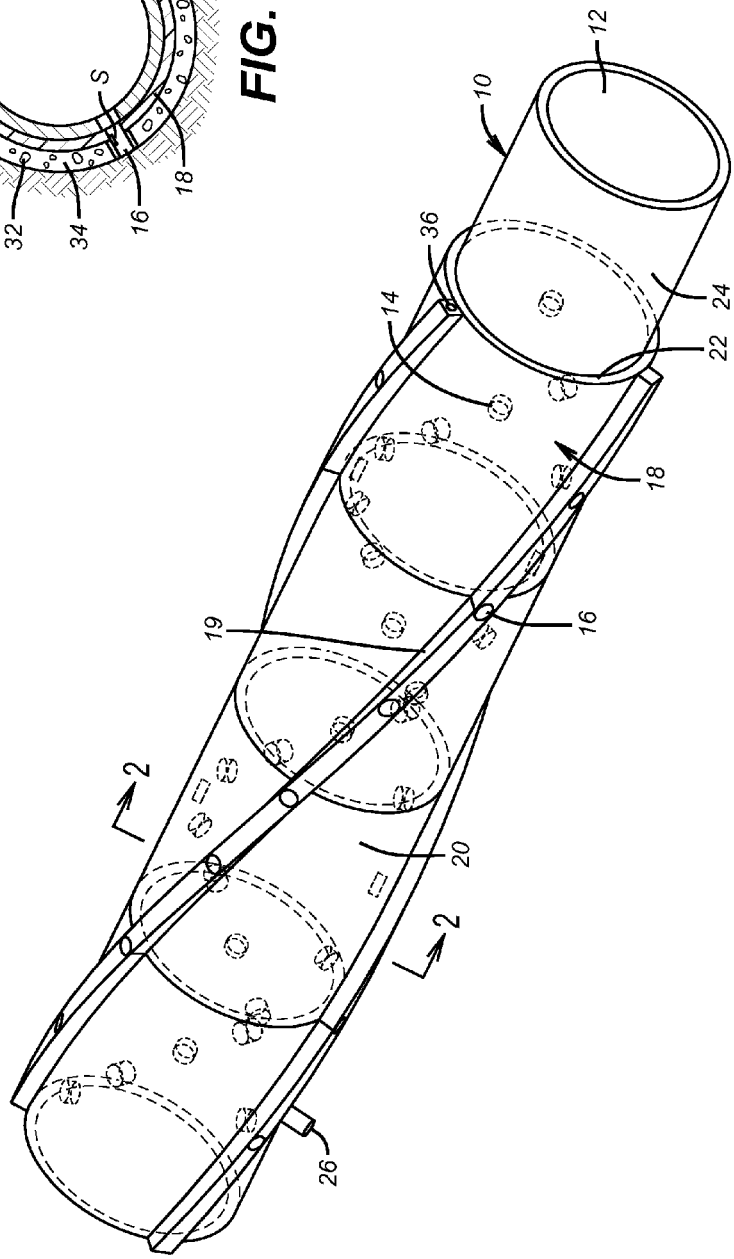
FIG. 1 is a perspective view of an expandable tubular with the external sleeve with ridges with openings in the ridges.

FIG. 1 shows a tubular 10 that can be expanded from within at inner wall 12 by known expansion techniques. The tubular 10 has a plurality of openings 14 that can have any desired shape and a predetermined layout that can be spiral, as shown, or other patterns. The openings 14 align with openings 16 on a cover 18. In the preferred embodiment, the openings 16 are disposed on a ridge or discrete projection 19 from cover 18 for each opening 16 so as to raise the openings 16 from the main outer surface 20 of the cover 18. For example, in FIG. 1 the ridges 19 are preferably spirally wound and equally spaced to create valleys at surfaces 20 between ridges 19. These valleys 34 can accept cement 32 or equivalent sealing material without fouling the openings 16. This can occur because expansion of the underlying tubular 10 or/and swelling of the cover 18 brings the openings 16 firmly against the borehole wall 30. The formation is produced through the openings 16 and 14. One end 22 is shown in FIG. 1 and is preferably sealed against the outer surface 24 of tubular 10. The other end is preferably similarly sealed.

Those skilled in the art will appreciate that cover 18 functions as a centralizer during run in and expansion of either tubular 10 or the swelling or growth of cover 18. The preferred material for the cover 18 is nitrile rubber or some other flexible elastomer that swells under exposure to certain well fluids. The cover 18 can be made of a different material than the ridges or projections 19. For example the projections or ridges 19 may be design to handle abrasion during run in while still being flexible enough to be pushed into a sealing relationship in the borehole under a compressive force, as opposed to the material for sleeve 18 can be made of a more stretchable material that will accommodate expansion of the tubular 10.

In operation the tubular 10 is expanded so as to leave a residual compressive force on the cover 18 while the openings 16 are firmly pressed against the borehole wall. The cover 18 will take the shape of the borehole wall at ridges or projections 19 to ensure a good seal at openings 16 against the borehole wall. After such an expansion, the valleys 20 will still leave room for cement to flow among the projections or ridges 19. Cement can be pumped from the bottom up using a technique well known in the art. There are no moving parts and each opening 16 on a ridge 19 is individually sealed against the borehole wall. Using the design with projections or ridges that have little standoff with respect to the average open hole diameter, a very low percentage of expansion will be needed to seal the openings 16 against the borehole wall. As an example, centralizers that have a similar shape that are used in an 8.5 inch open hole carry flutes with an outside diameter of 8.125 inches to 8.25 inches so than an expansion of the shape by only 3-4.6 percent is needed to seal the openings 16 against the borehole wall. Using commonly achieved percent of diametric expansions of 15 to 25%, it can be seen that sealing of the openings against the borehole wall will be more assured. The cover 18 is optional as ridges or projections 19 can be used in isolation. The openings 16 being sealed takes precedence to any incidental conforming to the borehole wall which may occur from deployment. Valleys can form at surfaces 20.

Expanding the tubular 10 is optional as swelling or other growth of the cover 18 can seal the openings 16 against the borehole wall. Alternatively, both expanding and growth of the cover 18 can take place at once or in sequence.

In a further option, the openings 16 can be sealed for run in and subject to being opened downhole by a variety of techniques, such as, chemical or thermal effects, pressure or other mechanical force. The act of expansion of the tubular 10 can dislodge plugs 17 out of openings 16. A stimulating agent such as an acid can be used to open the openings 16 and treat the surrounding formation near the openings 16. The treatment will clean out the openings 16 prior to production. As another option, a filter can be included in an insert that can be a non-elastomer, in openings 16 or in adjacent openings 14 in the tubular 10 for sand control capability. As another option, the projections or ridges 19 can be made of soft metals such as aluminum or copper. Alternatively, openings 16 can hold sensors S to detect and store or transmit well conditions such as temperature or pressure at given depths. Another option is to embed control lines 36 such as hydraulic, light or electrical in cover 18 or ridges 19.

The projections or ridges can take on a variety of shapes and layouts. Ridges can be longitudinal or spirally wound or they can be a series of circumferential rings. Rather than a complete cover 18 the outer wall 24 can alternatively have ridges at the locations of openings 14 of the tubular 10. The cover 18 can be a seamless sleeve or it can have a longitudinal seam. It can be secured to the tubular 10 with adhesives or other boding agents. Alternatively, the sleeve 18 can be fabricated right onto the tubular 10.

As another variation, telescoping pistons, shown schematically as 26 can be additionally used so that there is deeper penetration into the borehole wall. The pistons can be supported by either the tubular 10 or the ridges or projections 19 and can be of a design already known in the art as shown in the referred to SPE papers.

It is to be understood that this disclosure is merely illustrative of the presently preferred embodiments of the invention and that no limitations are intended other than as described in the appended claims.

We claim:

1. A tubular assembly for completion against a borehole wall from a surface, comprising:

a tubular string comprising a plurality of axially spaced tubular openings in a wall thereof and having an outer surface;

at least resilient elongated projection that is a single integral part that extends generally longitudinally and is supported on the outer surface of said wall and having at least one projection opening in fluid communication with said tubular openings;

said projection sealing said projection opening against the borehole wall upon a change in dimension of at least one of said tubular member and said projection leaving a continuous elongated gap between the tubular and the borehole wall which gap extends longitudinally at least as far as a plurality of axially spaced said openings such that the flow into the tubular is exclusively through said at least one projection opening.

2. The assembly of claim 1, wherein:

said projection is movable toward the borehole wall by expansion of said tubular member.

3. The assembly of claim 1, wherein:

said projection is movable toward the borehole wall by growth of said projection in the borehole.

4. The assembly of claim 1, wherein:

said at least one projection opening comprises a plurality of projection openings;

whereupon contact with the borehole wall by said projections, said gap is defined between the borehole wall and the tubular wall offset from said projections.

5. The assembly of claim 4, further comprising:

a sealant inserted into said gap.

6. The assembly of claim 4, wherein:

said projections each comprise more than a single projection opening.

7. The assembly of claim 6, wherein:

said projections are disposed in a pattern.

8. The assembly of claim 1, wherein:

said projections extend in a spiral.

9. The assembly of claim 7, wherein:

said projections extend circumferentially.

10. The assembly of claim 6, wherein:

said projections extend from a sleeve that covers said tubular member.

11. The assembly of claim 10, wherein:

said sleeve has opposed ends sealingly engaged to said tubular member.

12. The assembly of claim 10, wherein:

said projections are formed of a swelling material.

13. The assembly of claim 10, wherein:

at least one of each pair of tubular and projection openings are initially sealed with a selectively opened seal.

14. The assembly of claim 13, wherein:

said seal is selectively opened by one condition selected from the group consisting of exposure to well conditions, pressure and expansion of said tubular member.

15. The assembly of claim 13, wherein:

said seal further comprises a telescoping member that is extendable toward the borehole wall beyond said projections.

16. The assembly of claim 10, wherein:

at least one of said sleeve and said projections comprise at least one control line.

17. The assembly of claim 6, wherein:

said projections are made of a material selected from the group consisting of a flexible elastomer and a soft metal.

18. The assembly of claim 1, wherein:

said change in diameter to seal said projection opening is as low as 3% as compared to the initial diameter.

19. The assembly of claim 18, wherein:

said change in dimension occurs only in one of said tubular member and said projection.

20. The assembly of claim 18, wherein:

said change in dimension is split between both said tubular member and said projection.

21. The assembly of claim 1, wherein:

one of said tubular and projection openings comprise a filter or a sensor of well conditions.

* * * * *